United States Patent [19]

Toyoda et al.

[11] 4,002,151

[45] Jan. 11, 1977

[54] DIESEL ENGINE AND METHOD FOR IMPROVING THE PERFORMANCE THEREOF

[75] Inventors: Eiji Toyoda, Toyota; Masaaki Noguchi, Nagoya; Yukiyasu Tanaka; Tsuchio Bunda, both of Okazaki; Masaharu Sumiyoshi, Toyota, all of Japan

[73] Assignee: Toyota Jidosha Kogyo Kabushiki Kaisha, Japan

[22] Filed: May 6, 1975

[21] Appl. No.: 574,935

[30] Foreign Application Priority Data

May 13, 1974 Japan ..... 49-53710

[52] U.S. Cl. ..... 123/3; 123/1 A; 123/75 B; 123/122 G

[51] Int. Cl.[2] ..... F02B 43/08

[58] Field of Search ..... 123/122 G, 32 ST, 3, 123/75 B, DIG. 4, 1 A, 119 E

[56] References Cited

UNITED STATES PATENTS

| | | | |
|---|---|---|---|
| 1,728,027 | 9/1929 | Woolson | 123/122 G |
| 1,803,684 | 5/1931 | Woolson | 123/122 G |
| 3,682,142 | 8/1972 | Newkirk | 123/3 |
| 3,717,129 | 2/1973 | Fox | 123/3 |
| 3,828,736 | 8/1974 | Koch | 123/1 A |
| 3,908,606 | 9/1975 | Toyoda et al. | 123/3 |

*Primary Examiner*—Wendell E. Burns
*Assistant Examiner*—David D. Reynolds
*Attorney, Agent, or Firm*—Oblon, Fisher, Spivak, McClelland & Maier

[57] ABSTRACT

A diesel engine characterized in that a part of fuel is reformed into a mixture containing decomposition and oxidation products in a system separate from that of a fuel injection in which a fuel is injected into a compressed air introduced into the cylinders under a high pressure and ignited, and said mixture is introduced into said cylinders during the suction stroke of the engine, and the method for improving the combustion efficiency thereof.

17 Claims, 3 Drawing Figures

DIESEL ENGINE AND METHOD FOR IMPROVING THE PERFORMANCE THEREOF

BACKGROUND OF THE INVENTION

1. Field of the invention

This invention relates to a method for improving the combustion efficiency of a diesel engine and the diesel engine.

2. Description of the Prior Art

In a diesel engine, heretofore, fuel is ignited by injecting the fuel into the compressed air taken in the cylinders under a high pressure. According to this method, the diesel engine unfavourably tends to cause a diesel engine knock. The diesel engine according to this invention improves the combustion efficiency of the engine by reducing the diesel engine knock and increasing the performance thereof.

SUMMARY OF THE INVENTION

The primary object of this invention is to provide a method for improving the combustion efficiency of a diesel engine characterized in that, in the type of a diesel engine wherein fuel is ignited by injecting itself into the compressed air introduced in the cylinders under a high pressure, another quantity of the fuel is reformed and introduced into the cylinders during the suction stroke of the engine in a system separate from a fuel injection system.

Another object of this invention is to provide a diesel engine characterized in that, in the type of a diesel engine wherein fuel is ignited by injecting itself into the compressed air introduced into the cylinders under a high pressure, an auxiliary air intake pipe is connected to a part of a main air intake pipe, a reformer is provided in said auxiliary air intake pipe, which reforms a separately introduced auxiliary fuel from a main fuel to be supplied by the fuel injection system, and this reformed auxiliary fuel is then introduced into the cylinders during the suction stroke of the engine.

Other objects will become apparent from the Description of Preferred Embodiment.

Figure 1:
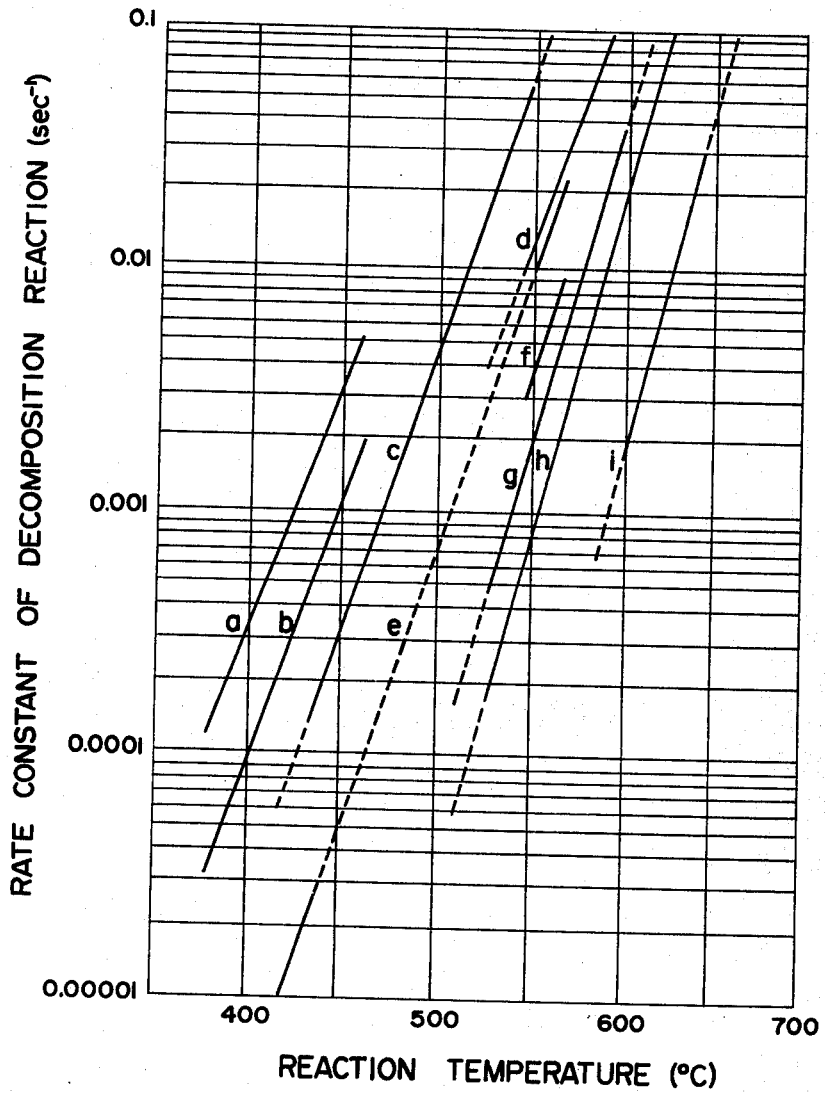
FIG. 1 shows the relationship between the rate constant of decomposition reaction and the reaction temperature of various hydrocarbons and petroleum distillates.

DESCRIPTION OF THE PREFERRED EMBODIMENT:

This invention is to provide a diesel engine with a reduced diesel engine knock and an improved performance thereof by improving the combustion efficiency of the engine in the type of the diesel engine wherein ignition is carried out by injecting a fuel into the compressed air taken into the cylinders under a high pressure, characterized in that an auxiliary fuel in an amount proportional to that of a main fuel is separately reformed into a mixture comprising decomposition and oxidation products and the mixture of fuel hydrocarbons from the main fuel supply system to be ignited by a fuel injection in order to improve the combustion efficiency, and thus reformed fuel is introduced into said sylinders during the suction stroke of the engine.

According to this invention, the combustion efficiency of a diesel engine is improved as follows;

It has been well known that a pilot injection, auxiliary injection and fumigation are very effective in improving the combustion efficiency of a diesel engine. P. H. Schweitzer stated that diesel knock is reduced by the fumigation improving the engine efficiency in his Report published in SAE Transactions Volume 66, 1958.

Diesel knock is generally attributed to an undue increase of the ratio of dp/de where P denotes an explosion pressure and $\theta$ a crank travel angle, said ratio of dp/de having an interrelationship with an ignition delay. Although the factors for the ignition delay can not unconditionally be judged with the physical and chemical factors being entangled complicatedly, it is clear that a preflame reaction plays an important role in the delay. In the process of a preflame reaction, intermediates such as lower hydrocarbons and oxygen-containing compounds such as aldehydes, ketones and peroxides as well as chain carriers taking part in the combustion are generated by a thermal decomposition or slow oxidation reaction of fuel. Accordingly, the ignition delay can be shortened by supplying a sufficient amount of the intermediates of these hydrocarbons and chain carriers in advance right before the injection of a main fuel or by generating a sufficient amount of these compounds in the combustion chamber at the time of injection. In short, the presence of an active preflame reaction occuring during the compression stroke before the main fuel injection can not only shorten the ignition delay but also improves the combustion thereafter. Further, there is recognized a great difference in the kind of fuel to be used of the preflame reaction when it is observed in the compression stroke after a fumigation is carried out with various kinds of fuel. This invention aims at carrying out, what is called, a fumigation in a diesel engine where a part of supplied fuel is reformed into a mixture comprising decomposition and oxidation products and the mixture of fuel hydrocarbons, the mixture being introduced into the cylinder thereafter.

When this reformed fuel is introduced into the cylinders, an active preflame reaction takes place in the process of the compression stroke, thereby supplying sufficient intermediates of hydrocarbons and chain carriers before the injection of main fuel.

Consequently, the injection delay is shortened remarkably. Moreover, apart from the above, the improvement of air utilization rate and burning velocity improve the performance. As mentioned above, this invention is to introduce into the cylinders a reformed fuel containing a relatively large amount of intermediates through the reformation of a part of fuel and this reformed fuel spreads comparatively uniformly all over the internal space of the cylinders in the suction and compression strokes causing an active preflame reaction in the meantime. In this invention, an active preflame reaction takes place all over the space increasing the burning velocity after the ignition by a main fuel injection remarkably and reducing afterburning as compared with the type of a conventional diesel engine in which air is present only in the vicinity of a main injection fuel source, thereby enhancing the combustion all over the internal space of the cylinders and improving the air utilization rate. Consequently, the amount of smoke generated in the cylinder is reduced improving the performance remarkably.

The combustion efficiency of a diesel engine is improved from a chemical point of view.

In the process of a combustion by compression ignition, the composition of hydrocarbons constituting a fuel and the combustion efficiency of hydrocarbons greatly influence the ignition of the injected fuel and the spreading of flame. This is because the liquid particle of fuel injected into the combustion space of the cylinders maintained under a high temperature and high pressure evaporizes and the evaporized hydrocarbons influence the ignition mechanism in its processes up to the ignition, which is subjected to a slow oxidation reaction accompanied by cool flame. Furthermore, the composition of hydrocarbons constituting the fuel and the combustion efficiency thereof also influence flame propagation speed affecting the travelling reaction zone surrounding the ignition nuclei present in a combustible jet mixture and the burning velocity at the interface between the flame and the combustible mixture.

The composition of hydrocarbons constituting a fuel for a diesel engine is not uniform and according to the analysis made by such a method as Fluorescent Indicator Adsorption method, a diesel fuel is composed of alkanes consisting of n- and isoparaffines, naphthenes consisting mainly of monocyclo- and bicycloparaffines and the balance being olefins having one, two or more aromatic rings and none of the aromatic ring.

Generally, it is recognized that the ignition efficiency of diesel fuel has the relation with the phenomenon of an ignition delay in the cylinders, and from the view point of the hydrocarbons constituting the fuel, n-paraffins of the fuel displays the best ignition property followed in a decreasing order by olefins, naphthenes, iso-paraffines and aromatic hydrocarbons. This is evident from the fact as shown in FIG. 1 showing the rate constant of decomposition reaction of various hydrocarbons and petroleum distillates, that usually heavier petroleum distillates are easy of decomposition at low temperatures and that in the spontaneous ignition temperature indicating a minimum temperature of combustion in which a fuel burns itself in flame when hydrocarbon fuel is heated in the air, as shown in FIG. 2, it goes down accordingly as the boiling point rises in homologues and in ones with the same molecular weight, it goes down in the following order, aromatice hydrocarbons, naphthenes and paraffines.

Figure 2:
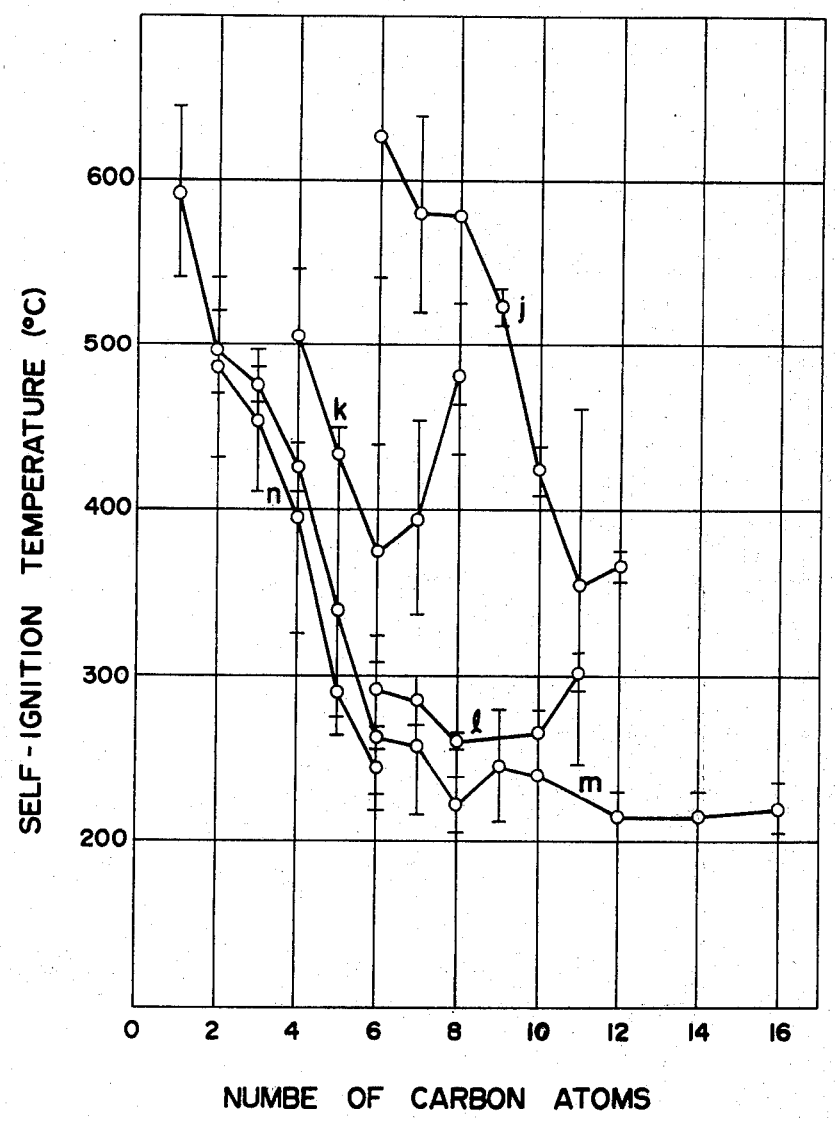
FIG. 2 shows the spontaneous ignition temperature of the various hydrocarbons.

In FIGS. 1 and 2, *a* shows an asphalt, *b* an atmospheric distillation-residual oil, *c* a light oil, *d* naphtha, *e* hexane, *f* pentane, *g* butane, *h* propane, *i* ethane, *j* mononuclear aromatic hydrocarbons, *k* iso-paraffins, *l* cycloparaffins, *m* n-paraffins, *n* monoolefins.

Further, the burning velocity of a premixture related to flame propagation after the ignition of a combustible mixture in the cylinders affects the completion of combustion processes. In other words, the burning velocity changes according to the composition of hydrocarbons constituting the premixture. In the hydrocarbons having the same number of carbon atoms, the burning velocity increases as the degree of unsaturation increases and in homologues, it decreases as the number of carbon atoms increases except paraffins.

The burning velocity of paraffins is about the same as ones with more carbon atoms, while aromatic hydrocarbons show the same burning velocity as other hydrocarbons. However, oxygen-containing compound has the burning velocity higher than hydrocarbons. The increase of the burning velocity of the hydrocarbons is attained by the reformation reaction through decomposition and oxidation in which the opening of rings by breaking C—C bonds thereby producing small oxidation compounds and the increase of the degree of ussaturation with the compounds by spliting hydrogen off C—H bonds of the compounds are effected.

It has been known that, when a fuel with a low cetane number which is of poor ignition is used, a normal combustion is difficult to be effected because of the longer time of ignition delay, however, if the fuel is added with an oxidizing agent such as organic peroxide or nitrate and then introduced into the cylinder, the combustion in the cylinder can be improved. This fact is explained by the result that upon burning hydrocarbons, a promotor of the generation of the reaction products is separately supplied which is to be accumulated during the induction period of oxidation reaction that is a preflame reaction, thereby facilitating the start of combustion and increasing the burning velocity of gaseous mixture in flame propagation.

The reforming of fuel is carried out under the following reforming conditions. For instance, if a part of the supplied diesel light oil having a boiling-point range of 10% at a distillation temperature of 230° C and 95% at 330° C is burnt at a comparatively low temperature and a low oxygen concentration, that is, at 400° – 800° C under atmospheric pressure within the range of an air-fuel weight ratio of 1 to 5, using $\alpha$-alumina as a catalyst on condition of a liquid hourly space velocity of 0.5 – 5.0 and it is reformed in vapor phase with thus generated steam within a range of steam-fuel ratio of 0.1 – 0.5 by weight, a gaseous product of oxygen-containing compounds is obtained which is the oxidation product of non-hydrocarbons such as hydrogen, carbon monoxide and carbon dioxide, and hydrocarbons having 1 – 6 carbon atoms generated at a conversion rate of 30 – 80%, together with a liquid unreacted, decomposition and oxidation products and a mixture of hydrocarbons.

In other words, a mixture comprising decomposition and oxidation products and the mixture of fuel hydrocarbons is obtained.

According to an analysis of liquid unreacted and decomposition and oxidation products and the mixture of hydrocarbons carried out by a fluorescent indicator adsorption method, hydrocarbon components constituting material diesel light oil is remarkably reformed through the decomposition in vapor phase as mentioned above wherein the contents of alkanes such as n- and iso-paraffins and naphthenes composed mainly of mono-and bi-cycloparaffines markedly decrease while the content of olefins hydrocarbons composed mainly of mono- and di-olefins increases.

In other words, the hydrocarbon component of a diesel fuel is reformed by dehydrogenation through a treatment under the presence of a small amount of air and moisture of the hydrocarbon component constituting the diesel fuel, generation of lower hydrocarbons through the chemical bond rupture of hydrocarbons, a process of decomposition and oxidation reaction such as production of olefins hydrocarbons by opening rings.

The composition of said products contained in the mixture comprising decomposition and oxidation products and the mixture of fuel hydrocarbons can be changed by allowing for such reforming conditions as temperature, air to fuel weight ratio, use of a catalyst and the selection thereof.

The said mixture comprising decomposition and oxidation products and the mixture of fuel hydrocarbons itself contributes to the improvement of combustion consisting of intermediates serving to improve the combustion after being introduced into the cylinders or a mixture easily producing chain carriers.

Figure 3:
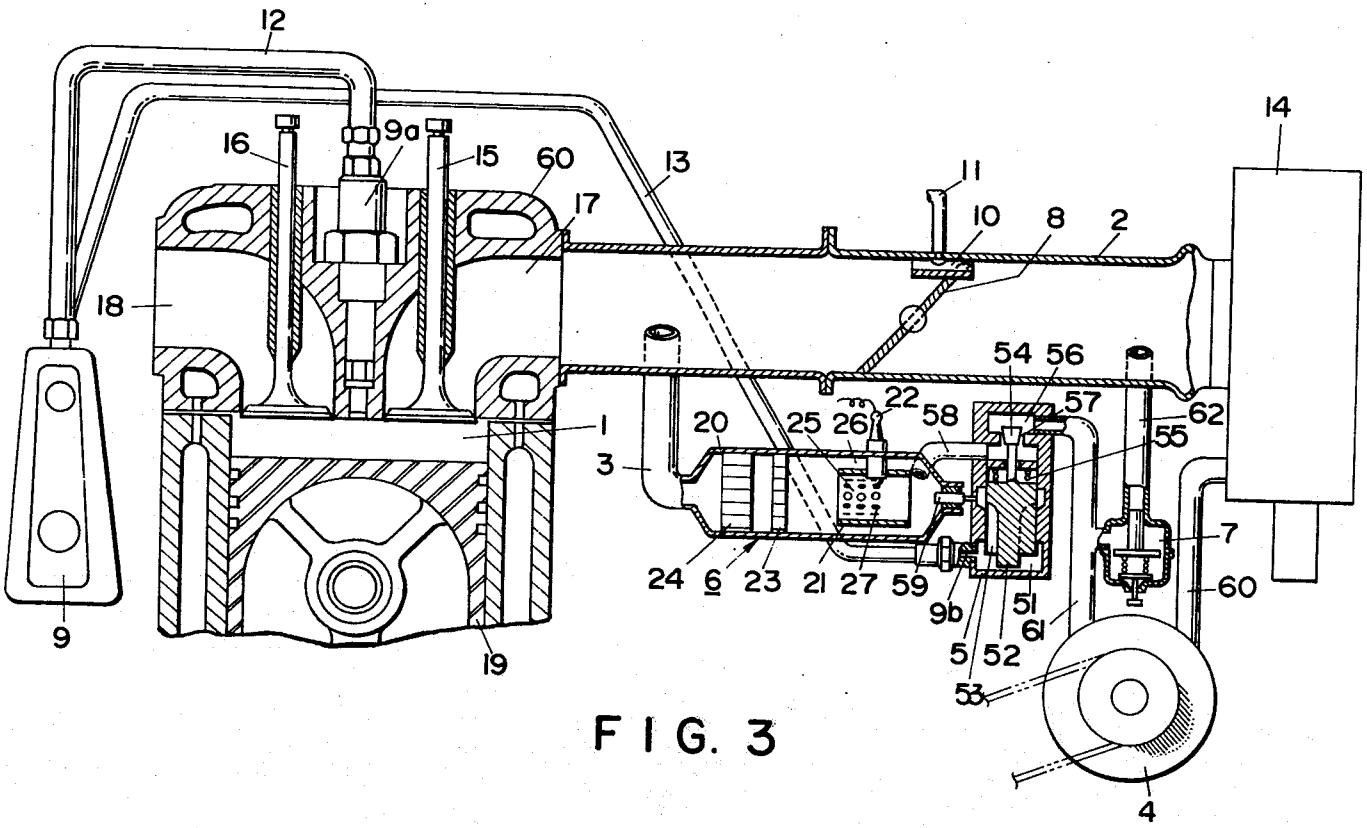
FIG. 3 is a schematic view illustrating an embodiment of the present invention.

FIG. 3 shows one embodiment of the diesel engine of this invention, where 1 indicates a cylinder, 2 a main air intake pipe.

An auxiliary air intake pipe 3 is connected to a part of the main air intake pipe 2 and an air pump 4, air meter 5 and reforming means 6 are connected in that order to said air intake pipe 3 from upstream of the pipe. The air pump 4 is driven by the engine, the inlet of which is connected to an air cleaner 14 while the outlet to the air meter 5. At the same time, a pressure regulator 7 is provided downstream of the air pump 4 for maintaining the pressure of the air supplied from the air pump relatively low and constant, the excess air of the pressure regulator 7 flowing into the main air intake pipe 2.

Numeral 9 indicates a fuel injection means (an injection pump) having a pneumatic governor for use in an ordinary diesel engine. Numeral 10 is an auxiliary venturi-tube provided at the outlet for a venturi negative pressure of a main throttle valve 8 in the main air intake pipe 2, which is connected to a vacuum chamber of said fuel injection means 9 via the negative pressure outlet pipe 11. The vacuum chamber is connected to a control rack via a disphragm, and through the change of position of the control rack, the amount of a main fuel injection is changed. Numeral **9*a* is a fuel injection nozzle, each being provided on each cylinder head, which is connected to an injection pipe 12 and the said fuel injection pump 9 respectively. It acts to inject into the cylinders a required amount of a main fuel for the engine, which amount is measured and sent into by a plunger pump. 9*b* is an injection nozzle connected to an auxiliary fuel plunger pump (not shown) provided separately from the one for each cylinder in the fuel injection means 9 and to an injection pipe 13**, and is driven simultaneously by a cum axis for driving the plunger for each cylinder.

The structure of the plunger pump for an auxiliary fuel is entirely the same as that for a plunger pump for each cylinder. The diameter of a plunger is so set that the amount of fuel to be injected per stroke of a plunger pump for auxiliary fuel is within a range of from 8 to 25% of the total main fuel.

The air meter 5 comprises a fuel pool 51, control valve 52, spring 55, air inlet 56, variable orifice 57, air injection tube 58 and auxiliary fuel delivery tube 59 and said control valve 52 is provided with a groove 53 and a needle valve 54 at one end. Since control valve 52 is pushed back against the spring 55 accordingly as the path area of the groove 53 increases in proportion to the flow rate of auxiliary fuel injected into the fuel pool 51 by the injection nozzle 9b, the needle valve 54 moves such that the path area of the variable orifice 57 between the air inlet 56 and the air injection tube 58 is increased.

Thus the adaption of the path area and the like to the constancy of a weight ratio of the flow rate of air injected into the reforming means 6 and that of the flow rate of the auxiliary fuel can be attained easily. The air meter 5 acts to flow an auxiliary fuel in a fixed proportion to the flow rate of the main fuel measure a fixed weight ratio of air in proportion to the flow rate and introduce it with said fuel into the reforming means 6.

The reforming means 6 reforms the fuel and air from the air meter 5 in said means and flow the reformed gaseous mixture into the main air intake pipe 2. It comprises inside a housing 20 from its upstream an air inlet tube 58, auxiliary fuel injection tube 59, combustion cylinder 21, ignition means 22, reaction beds or catalyst beds 23 and 24.

The combustion cylinder 21 has openings at both ends forming an inner path 25 inside the combustion cylinder and an outer path 26 between the combustion cylinder 21 and the housing 20, said inner path 25 and outer path 26 communicating with each other at both ends of the combustion cylinder 21. Further, the combustion cylinder 21 has numerous perforations 27 through which the said inner path 25 and the outer path 26 communicate with each other.

The portion where a plug is mounted at the top of an ignition means 22 opens. Said air inlet tube 58 opens into the outer path 26 in the vicinity of said auxiliary fuel injection tube 59 and the air flowing from the air inlet tube 58 goes partly into the inner path 25 directly, another part of which going into the inner path 25 through the perforations 27 of the combustion cylinder 21, and the remaining part joining in the one flowing through the inner path at the down stream of the combustion cylinder 21 through the outer path 26. The fuel is injected into the inner path 25 directly from the auxiliary fuel injection tube 59. The ignition means 22 is of an ordinary ignition system for use in a conventional spark-ignition type internal combustion engine only without a distributor kit. The first reaction bed 23 is composed of such a refractory as alumina and the like in the form of a honeycomb having a function as heat-storage as well as that of preventing the flame from flowing downstream. It is followed by the reaction bed 24 holding a catalyst material as necessary.

In the figure, 15 is an intake valve, 16 an exhaust valve, 17 an intake port, 18 an exhaust port and 19 a piston.

Next, in the embodiment of this invention constituted as the above, the fuel introduced into the cylinder 1 is supplied as main fuel from the fuel injection means 9 and the injection nozzle **9*a*. As mentioned above, the measured and fixed rate of the flow rate of fuel of 8 – 25% of the main fuel is supplied as auxiliary fuel into the auxiliary fuel injection tube 59 of the reforming means 6 via the injection nozzle 9*b* and the air meter 5. The air meter 5 detects and measures the flow rate of fuel, controlls the flow rate of air such that the air-fuel weight ratio becomes constant (selecting one from 1 – 5) and introduces it into the air inlet tube 58. In the reforming means 6, the auxiliary fuel injected into the inner path 25 becomes liquid particles and in the process of passing through the air supplied into the combustion cylinder 21 from the air inlet tube 58, an ignitable and combustible mixture is formed on the surface of the particles, causing them easy to ignite and burn in flame by an ignition through electric spark generated in the plug at the top of the ignition means 22**. Although heat generation in the burning enhances the evaporation of the liquid particles since the air is not supplied in a sufficient amount as mentioned above to effect a perfect combustion, a part of the auxiliary fuel burns and the remaining part either gasifies or decomposes into a fuel gas of high temperatute and the flame begins to vanish.

Since the gas flowing from the combustion cylinder 21 into the reaction bed 23 downstream turns out to be a gaseous mixture of high temperature consisting of a residual flame, burnt gas containing water generated by a partial combustion of the fuel, a small amount of air supplied from the outer path and fuel gas, it heats the reaction bed 23 in passing through the bed and at the same time, the flame vanishes making the temperature of the gaseous mixture uniform, the mixture in turn causing a decomposition and oxidation reaction. If the mixture is passed through the reaction bed 24 holding a catalyst material which is provided following the bed 23 as necessary, this reaction of the gaseous mixture is further pronounced. In other words, the composition of hydrocarbons is reformed. The reformed gaseous mixture passing through the reaction beds 23 and 24 joins in and is mixed with a main air in the main air intake pipe 2 and is introduced into the cylinder 1 during the suction stroke of the engine. As mentioned above, a mixture comprising decomposition and oxidation products and the mixture of fuel hydrocarbons as being a reformed fuel introduced into the cylinder 1 improves the combustion efficiency of diesel engine remarkably. In this embodiment, a favorable result is obtained when the flow rate of auxiliary fuel is 8 – 2o% of that of the main fuel. If it is set at less than 8%, a sufficient effect of fumigation is not obtained due to insufficient fumigation. If over 25%, an unfavorable ignition takes place before the main fuel injection to be effected at the completion of the compression stroke.

Furthermore, the said reforming conditions can be mitigated by selecting the catalyst material to be used in the reaction beds 23 and 24 with a view to promoting a decomposition and oxidation reaction on contact which is a part of the main reaction. When a catalyst is used by allowing for the essential conditions of catalyst and the like such as temperature, air to be supplied (oxygen concentration), liquid hourly space velocity of fuel hydrocarbons with regard to the amount of catalyst, the mixture comprising decomposition and oxidation products and the mixture of fuel hydrocarbons is selectively obtained which takes part in the combustion mechanism giving a favorable effect.

What is claimed is:

1. A method for improving the performance of a diesel engine comprising the steps of:

introducing a first mixture of a first quantity of fuel and a second quantity of air into a reformer;

reforming said first quantity of fuel in the presence of said second quantity of air into a second mixture containing decomposition and oxidation products;

feeding said second mixture to a combustion chamber of said engine;

feeding a third quantity of air to said combustion chamber, wherein said third quantity of air has not passed through said reformer;

injecting a fourth quantity of fuel into said combustion chamber, wherein said fourth quantity of fuel has not passed through said reformer;

burning said second mixture and said fourth quantity of fuel in said combustion chamber.

2. A method according to claim 1, wherein said second mixture and said third quantity of air are fed during the suction stroke of said engine.

3. A method according to claim 1, wherein said first quantity is within a range of 8–25% of said fourth quantity.

4. A method according to claim 1, wherein said reforming is carried out at 400°–800° c under atomospheric pressure.

5. A method according to claim 1, wherein an air-fuel ratio of said first mixture is 1–5.

6. A method according to claim 1, wherein said second mixture contains hydrogen and carbon monoxide.

7. A method according to claim 1, wherein said second mixture contains hydrocarbons which have 1–6 carbon atom.

8. A method according to claim 1, further comprising a step of comprising mixing said second mixture with said third quantity of air before feeding them to said combustion chamber.

9. A method according to claim 1, wherein said reforming step comprises igniting said first mixture by a ignition spark plug disposed in said reformer.

10. A method according to claim 1, wherein said reformer comprising a catalyst bed through which said first mixture passes.

11. A diesel engine for improving the performance thereof comprising:

a combustion chamber;

a piston disposed in said combustion chamber;

a power take-off mechanism operatively connected to said piston and cooperating therewith for producing and transmitting power produced in said combustion chamber; a main fuel injection system connected to said combustion chamber for injecting main fuel into said combustion chamber;

an air supply system connected to said combustion chamber for supplying an air into said combustion chamber;

a means for reforming fuel into a mixture containing decomposition and oxidation products and supplying said mixture into said combustion chamber;

an anxiliary fuel supply system connected to said reforming means for supplying anxiliary fuel into said reforming means;

an anxiliary air supply system connected to said reforming means for supplying an auxiliary air into said reforming means; and an exhaust system connected to said combustion chamber for discharging exhaust produced gases in said combustion chamber.

12. A diesel engine according to claim 11, wherein said reforming means comprises:

a reforming chamber connected to said air supply system means connected to said reforming chamber and said auxiliary fuel supply system and said auxiliary air supply system for metering the amount of said auxiliary fuel supplied through said auxiliary fuel supply system and controlling amount of auxiliary air to be fuel into said reforming chamber and an ignition spark plug disposed in said reforming chamber, said auxiliary fuel being ignited by said ignition spark plug and reformed in the presence of said auxiliary air.

13. A diesel engine according to claim 12, wherein said reforming means further comprises a catalyst bed disposed downstream of said ignition spark plug in said reforming chamber.

14. A diesel engine according to claim 12, wherein said reforming means further comprising a cylinder disposed is said reforming chamber, said cylinder having a perforated wall thereof, said ignition spark plug being disposed is said cylinder.

15. A diesel engine according to claim 12, wherein catalyst bedded in said catalyst bed is $\alpha$-alumina.

16. A diesel engine according to claim 12, wherein said controlling means is adapted to permit the flow rate of said auxiliary air in proportion to the flow rate of said auxiliary fuel.

17. A diesel engine according to claim 16, wherein an air fuel ratio of a mixture of said auxiliary fuel and air is 1–5.

* * * * *